US010874927B1

(12) United States Patent
Nicely

(10) Patent No.: US 10,874,927 B1
(45) Date of Patent: Dec. 29, 2020

(54) GOLF PUTTING AIDE

(71) Applicant: V-Flex Technologies, Inc., Kingsport, TN (US)

(72) Inventor: Timothy J. Nicely, Bean Station, TN (US)

(73) Assignee: V-Flex Technologies, Inc., Kingsport, TN (US)

( * ) Notice: Subject to any disclaimer, the term of this patent is extended or adjusted under 35 U.S.C. 154(b) by 0 days.

(21) Appl. No.: 16/361,746

(22) Filed: Mar. 22, 2019

(51) Int. Cl.
*A63B 69/36* (2006.01)
*A63B 102/32* (2015.01)

(52) U.S. Cl.
CPC ..... *A63B 69/3676* (2013.01); *A63B 2102/32* (2015.10); *A63B 2225/74* (2020.08)

(58) Field of Classification Search
CPC ..... A63B 2071/0694; A63B 69/3641; A63B 69/3676; A63B 2225/09; A63B 2210/50; A63B 69/3623; A63B 57/357; A63B 57/40; A63B 63/00; A63B 53/0487; A63B 69/36; A63B 2071/0655; A63B 2225/605; A63B 57/00; A63B 2102/32; A63B 2207/02
USPC ..... 473/172, 174, 183, 186, 188, 189, 195, 473/257, 265
See application file for complete search history.

(56) References Cited

U.S. PATENT DOCUMENTS 1,136,708 A * 4/1915 Osborn ..... A63B 57/357 473/189
1,598,865 A 9/1926 Limerick
1,965,838 A 7/1934 Stanley
2,126,102 A 8/1938 Fowier
3,507,499 A * 4/1970 Rice ..... A63B 69/3676 473/188
3,858,888 A * 1/1975 Young ..... A63B 57/40 473/186
3,873,097 A * 3/1975 Willis ..... A63B 63/00 473/189
4,007,938 A * 2/1977 Guenther ..... A63B 69/3676 473/188
4,057,248 A 11/1977 Stoecker
4,295,648 A 10/1981 Stromback
4,497,485 A 2/1985 Macosko
4,872,674 A 10/1989 Deal
5,145,178 A * 9/1992 Ropars ..... A63B 63/00 273/127 R
5,433,434 A 7/1995 Helmetsie
5,704,855 A 1/1998 Kellogg, Jr.
6,939,241 B1 9/2005 Chang
7,134,977 B2 11/2006 Campbell et al.
7,534,178 B2 5/2009 Nicely
7,648,421 B2 1/2010 Yoon
7,780,539 B2 * 8/2010 Whitefield ..... A63B 63/06 473/188
7,931,547 B2 4/2011 Bishop
8,727,902 B2 * 5/2014 Shipman ..... A63B 69/3676 473/265

(Continued)

*Primary Examiner* — Nini F Legesse
(74) *Attorney, Agent, or Firm* — Luedeka Neely Group, PC

(57) ABSTRACT

A golf putting aide locatable between a golf ball and a golf hole for use by a golfer putting the ball toward the hole to train the golfer to putt. The aide includes a frame supported by a support, the frame having a gap located at a lower portion of the frame and oriented so that during use of the aide when the ball is putted through the frame toward the hole the ball will pass through or below the slot on its path to the hole.

6 Claims, 4 Drawing Sheets

(56) References Cited

U.S. PATENT DOCUMENTS

| | | | | |
|---|---|---|---|---|
| 9,739,576 | B1 | 8/2017 | Venigalla | |
| 2002/0091021 | A1 | 7/2002 | Clabough | |
| 2004/0104534 | A1 | 6/2004 | Trapani | |
| 2005/0012266 | A1 | 1/2005 | Kelley et al. | |
| 2005/0079921 | A1* | 4/2005 | Brayton | A63B 67/02 473/174 |
| 2008/0171619 | A1 | 7/2008 | Nicely | |
| 2008/0248901 | A1 | 10/2008 | Mosier et al. | |
| 2012/0065003 | A1 | 3/2012 | Trout | |
| 2014/0148263 | A1* | 5/2014 | Litton | A63B 69/3676 473/257 |
| 2015/0321062 | A1 | 11/2015 | Tyndall | |

* cited by examiner

GOLF PUTTING AIDE

FIELD

This disclosure relates to the field of golf aides. More particularly, the disclosure relates to a golf aide configured to improve putting efficiency of a golfer.

BACKGROUND

Improvement is desired in aides for training a golfer to putt with improved efficiency. For example, in putting, a golfer will often misjudge the path to the hole and putt the ball along a path that deviates from the location of the hole as the ball rolls toward the hole. Also, in putting, a golfer will often misjudge the distance to the hole and either putt the ball past the hole or leave the ball short of the hole.

The present disclosure advantageously provides a putting aide configured to train golfers to better judge the path between the ball and the hole and to better judge the distance between the ball and the hole.

SUMMARY

The above and other needs are met by golf putting aides locatable between a golf ball and a golf hole for use by a golfer putting the ball toward the hole to train the golfer to putt.

In one aspect, he aide includes a frame supported by a support, the frame having a gap located at a lower portion of the frame and oriented so that during use of the aide when the ball is putted through the frame toward the hole the ball will pass through or below the slot on its path to the hole.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
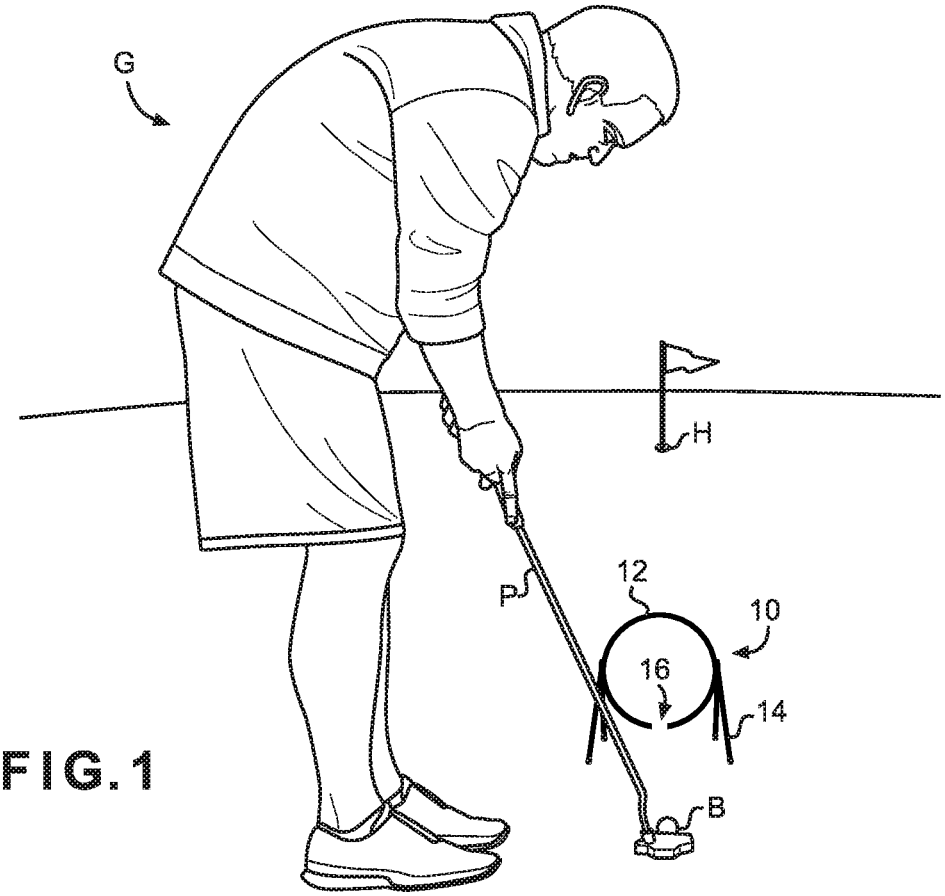
FIG. 1 shows a putting aide according to the disclosure.

With initial reference to FIG. 1, there is shown a putting aide 10 configured for aiding a golfer G in training to putt a golf ball B with a putter P more efficiently to a hole H. Efficiency as described herein refers to minimizing the number of putts required for the golfer G to putt the ball B into the hole H. In particular, the aide 10 is configured to train the golfer G to better judge the path between the ball B and the hole H and to better judge the distance between the ball B and the hole H.

It has been observed that the aide 10 is useful to train a golfer and that the training results in improved putting performance. While the structure described herein has been observed to be useful for the described training, why the structure works is not known. However, without being bound by theory, it is believed that the apparatus enhances the neurological space which defines the path to the hole, and thereby implicitly assists the golfer in judging path and distance of any particular putt. To achieve the desired consistency and effectiveness the golfer's brain must be exercised using a constraint led approach. This requires placing the golfer's brain under a constraint. Placing the brain's electrical system under a constraint requires manufacturing a constraint from electrical impulses from within the golfer's own brain. Greater putt efficiency and consistency is achieved by enhancing the brain's ability to exercise within its own intrinsic electrical parameters.

In this regard, the aide 10 includes a frame 12 supported by supports 14. The frame 12 is preferably circular or hoop-shaped or shaped as a tear drop or ellipse, but may be of other geometry such as a square or other polygon. Regardless of the geometry, the frame 12 is configured to define a slot gap 16 configured to be located at a lower portion of the frame 12 and oriented for the putted ball B to pass through the slot 16 or below the slot 16 on its path to the hole H. Whether or not the ball B basses through or below the slot 16 depends on the height that the frame 12 is supported by the supports 14 above the ground.

The gap 16 is visible to the human eye but it is also believed to serve as a coordinate and contour marker inside the golfer's brain. It is believed that the brain is firing impulses, considered to be exercise, in the gap location which allows the golfers brain to subconsciously convert depth or distance perception into an absolute location neurologically. This neurological activity is believed to alter the outcome of a locomotor related activity or task being performed by altering the amount of cognitive input necessary to perform the task. It is also believed that the brain of the golfer is more likely to repeat an intended action consistently if an internal reward is triggered by a successful putt while under a constraint. Training in an environment where a constraints led approach can be manipulated via natural neuro-electrical impulses through visual prompts within the electromagnetic field is believed to aid in building confidence and neural networks associated with becoming a successful putter.

Figure 2:
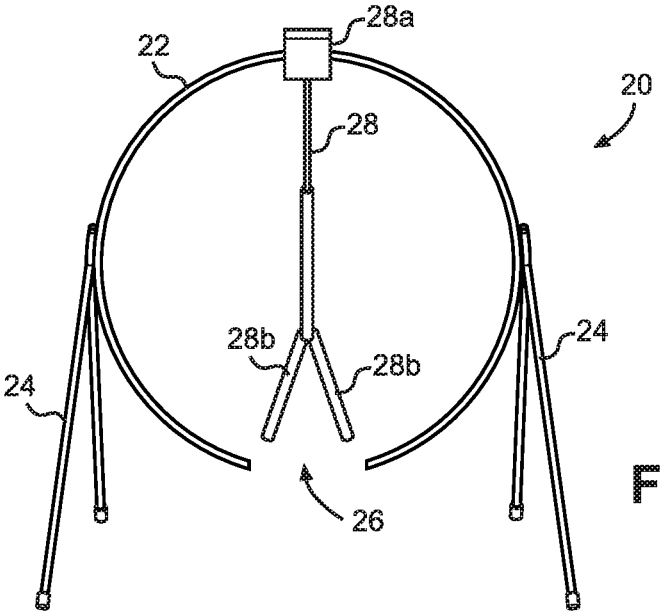
FIG. 2 shows an alternate embodiment of a putting aide according to the disclosure.

FIG. 2 shows another embodiment of a putting aide 20 having a frame 22 supported by supports 24, and defining a slot gap 26 configured to be located at a lower portion of the frame 22 and oriented for the putted ball to pass through on its path to the hole. The aide 20 is substantially identical to the aide 10, except it further includes a pendulum 28 located above the gap 26. An upper end of the pendulum 28 is mounted to the frame 22 by a mount 28*a* configured to enable the pendulum 28 swing freely backward and forward across the gap 26. A lower end of the pendulum 28 is configured to include a fork 28*b*. The fork 28*b* visually enhances the lower end of the pendulum 28 and also provides a surface that enhances surface area contact of the ball B with the lower end of the pendulum 28.

While the pendulum 28 could be configured to only swing in one direction, this would require care in placement of the aide 20 so that the pendulum 28 would be oriented to swing toward the hole H. Having the pendulum 28 be able to swing in both directions avoids this. Also, if desired, the pendulum 28 could be set into motion before the putt is attempted, with the motion of the pendulum 28 relative to the slot 26 further visually enhancing the slot 36.

Figure 3A:
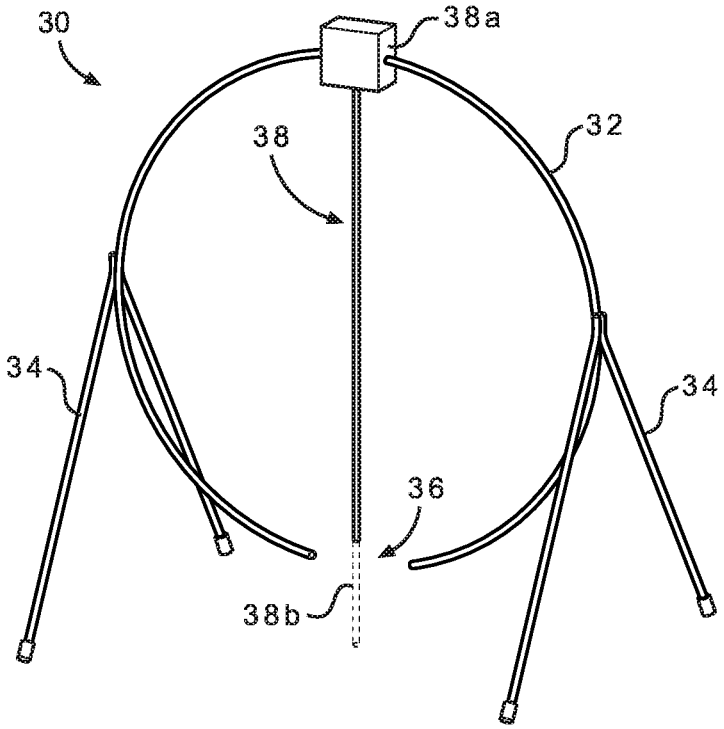
FIGS. 3A-3C show a further embodiment of a putting aide according to the disclosure.
Figure 3B:
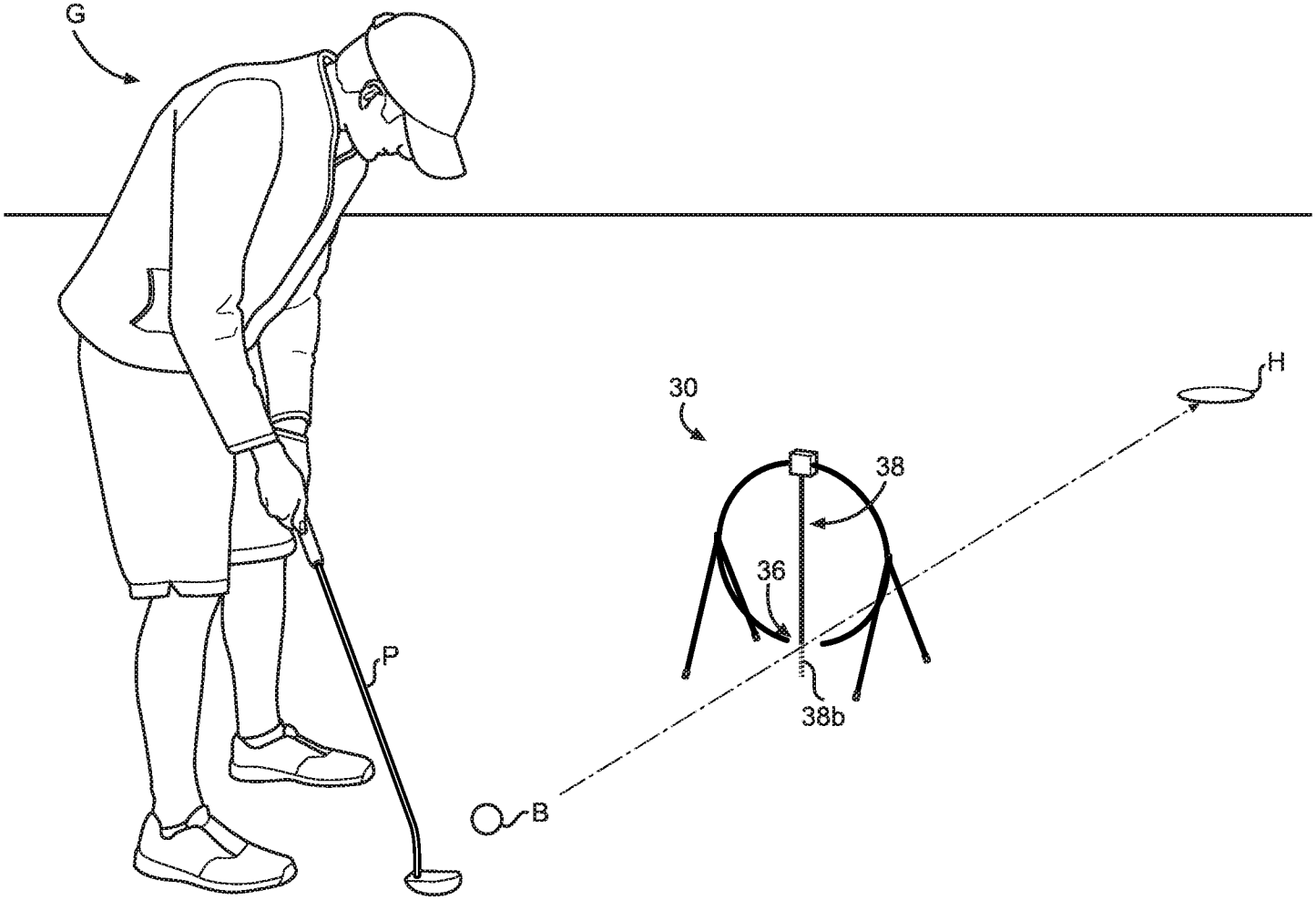
Figure 3C:
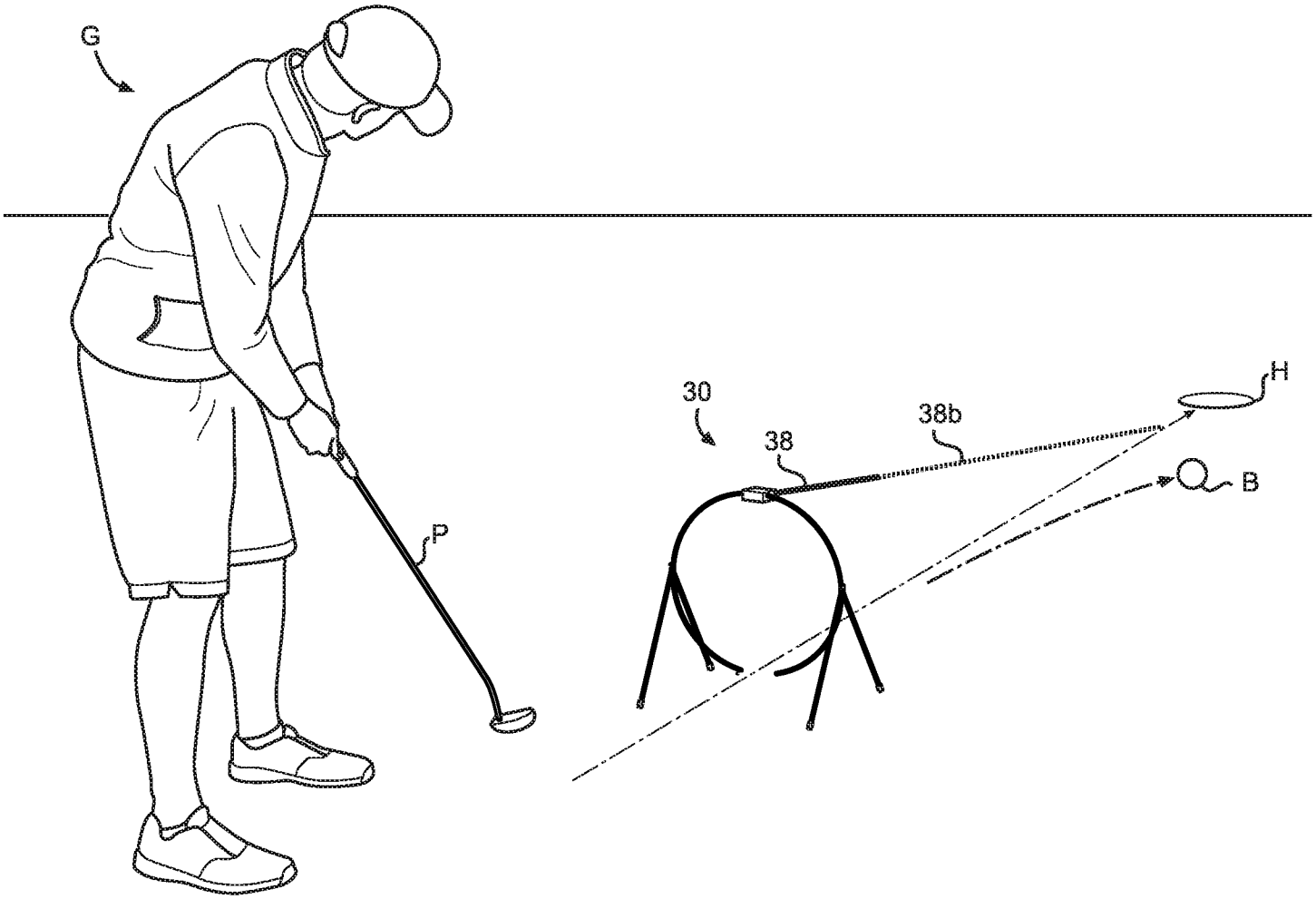

FIGS. 3A-3C shows another embodiment of a putting aide 30 having a frame 32 supported by supports 34, a slot gap 36 and a pendulum 38 located above the gap 36. An upper end of the pendulum 38 is mounted to the frame 32 by a mount 38*a* and a lower end of the pendulum 38 is configured to include an illumination beam preferably a laser 38*b* directed from the lower end of the pendulum 38.

The laser 38*b* visually enhances the lower end of the pendulum 38 and also provides a visual enhancement of a desired path to the hole H once the ball B has passed through the gap 36. For example, as shown in FIG. 3B, the beam 38*b* cooperates with the slot 36 to visually enhance the location of the slot 36. As the ball B passes through or below the slot 36, the ball B contacts the lower end of the pendulum 38 and causes the pendulum 38 to swing in a direction so that the beam 38*b* is directed toward the hole H and provides a visual enhancement of a linear path (as indicated by the dashed line) to the hole H. Any deviation of the ball B from the linear path can readily be noticed by the golfer as the ball B will be deviated from the beam 38*b*.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A golf putting aide locatable between a golf ball and a golf hole for use by a golfer putting the ball toward the hole to train the golfer to putt, the aide comprising: a continuous frame supported by a support, the frame being continuous except having a space between converging downwardly angled portions of the frame which define a narrow gap located at a lower portion of the frame and oriented so that during use of the aide when the ball is putted through the frame toward the hole the ball will pass through or below the gap on its path to the hole; and a pendulum mounted to the frame above the gap and configured to swing freely backward and forward across the gap.

2. The aide of claim 1, further comprising a fork located at a lower end of the pendulum and configured and located to be contacted by the ball when the ball passes pass through or below the gap on its path to the hole.

3. The aide of claim 1, further comprising an illumination beam directed from a lower end of the pendulum.

4. The aide of claim 3, wherein the illumination beam comprises a laser beam.

5. A golf putting aide locatable between a golf ball and a golf hole for use by a golfer putting the ball toward the hole to train the golfer to putt, the aide comprising: a frame supported by a support, the frame having a gap located at a lower portion of the frame and oriented so that during use of the aide when the ball is putted through the frame toward the hole the ball will pass through or below the gap on its path to the hole; a pendulum mounted to the frame above the gap and configured to swing freely backward and forward across the gap; and an illumination beam directed from a lower end of the pendulum.

6. The aide of claim 5, wherein the illumination beam comprises a laser beam.

* * * * *